US005469983A

United States Patent [19]

Yawata

[11] Patent Number: 5,469,983

[45] Date of Patent: Nov. 28, 1995

[54] HEAT INSULATING CONTAINER AND CONTAINER HOLDING MEMBER

[75] Inventor: Masaya Yawata, Moriyama, Japan

[73] Assignees: Sado Yawata; Masaki Kato, both of Shiga, Japan

[21] Appl. No.: 357,214

[22] Filed: Dec. 13, 1994

[30] Foreign Application Priority Data

Jun. 19, 1993 [JP] Japan ..... 5-187708

[51] Int. Cl.[6] ..... B65D 25/34

[52] U.S. Cl. ..... 220/412; 220/753; 220/739

[58] Field of Search ..... 220/412, 753, 220/739

[56] References Cited

U.S. PATENT DOCUMENTS

| | | | |
|---|---|---|---|
| 4,928,873 | 5/1990 | Johnson | 220/739 |
| 5,169,025 | 12/1992 | Guo | 220/739 |
| 5,222,656 | 6/1993 | Carlson | 220/739 |
| 5,318,821 | 6/1994 | Bradley, Jr. | 220/739 |

*Primary Examiner*—Joseph Man-Fu Moy

*Attorney, Agent, or Firm*—Armstrong, Westerman, Hattori, McLeland & Naughton

[57] ABSTRACT

A heat insulating container according to the present invention comprises a container body and a laminated body in which base materials which differ in heat shrinkage percentages are laminated, the base materials in the laminated body are bonded to each other by bonded portions spaced apart from each other, and the base material having a high heat shrinkage percentage is mounted with it directed toward an outer surface of the container body. Furthermore, a container holding member according to the present invention is so adapted that a laminated body in which base materials which differ in heat shrinkage percentages are laminated after being bonded to each other by bonded portions spaced apart from each other is provided in a holding member body in a shape corresponding to the shape of a container, and the base material having a high heat shrinkage percentage in the laminated body is positioned on the inner side with it opposed to the container.

9 Claims, 13 Drawing Sheets

HEAT INSULATING CONTAINER AND CONTAINER HOLDING MEMBER

BACKGROUND OF THE INVENTION

1. Field of the Invention

The present invention relates to a container containing hot drink, hot food or the like, and more particularly, to a heat insulating container through which heat from the hot contents is not easily conducted to the hand of a person who has the container even if it is composed of a material having a small wall thickness, for example, a paper cup, and a container holding member for holding the container containing hot drink, hot food or the like so that the heat is not easily conducted to the hand.

2. Description of the Prior Art

As a container containing hot drink, hot food or the like, various types of containers have been used. In a vending machine or a vehicle such as a railroad, a cup made of paper or foaming resin which is formed in the shape of an inverted circular truncated cone has been generally used as such a container in that it is low in manufacturing cost and can be stored without being bulky.

Such a cup made of paper or foaming resin does not have sufficient heat insulation properties. If hot drink or the like is contained in the cup, the cup gets hot. Particularly in the case of the cup made of paper frequently utilized, the cup immediately gets hot, thereby to make it difficult for a person to have the cup in his or her hand.

Therefore, such development has been conventionally achieved as to reduce conduction of heat from hot drink or the like contained in the cup through the cup to the hand of a person who has the cup. A container 1 in which a pair of handle portions 2 made of a paperboard which is subjected to punching processing in a butterfly shape is mounted on an outer surface of a body portion 1*a* and which is so adapted as to be held by a person with the pair of right and left handle portions 2 in his or her hand after the handle portions 2 are bent and raised in the positions of lines for bending 2*a*, as shown in FIG. 14, is disclosed in Japanese Utility Model Laid-Open Gazette No. 24714/1985. In addition, a container 3 in which a body portion 4 has a double structure comprising an inner body portion 4*a* and an outer body portion 4*b*, and an air layer 4*c* is provided therebetween, as shown in FIG. 16, is disclosed in Japanese Utility Model Laid-Open Gazette No. 52003/1975.

In the case of the container 1 shown in FIG. 14, the handle portions 2 are brought into close contact with the body portion 1*a* in the container 1 until they are raised as described above. Subsequent containers can be successively stacked in the container 1 in such a manner that one of the containers is put in the other container, so that they can be stored without being bulky, similarly to the conventional paper cups.

In this container 1, however, the handle portions 2 must be raised from the body portion 1*a* with the fingers of the person as described above before hot drink is contained, whose operation is laborious. If hot drink or the like is contained in the container 1 without performing the operation, the body portion 1*a* and the handle portions 2 in the container 1 get hot, thereby to make it difficult to raise the handle portions 2. Further, if the person lets go of the handle portions 2 after raising the handle portions 2 from the body portion 1*a*, the handle portions 2 are independently returned by a restoring force of the paperboard used for the handle portions 2, as shown in FIG. 15. Therefore, every time the container 1 is held, the handle portions 2 must be raised, which is very laborious. Further, if hot drink or the like is contained in the container 1, a large force is exerted on portions on which the handle portions 2 are mounted, whereby the handle portions 2 may come off the container 1. Therefore, the handle portions 2 must be firmly mounted on the container 1, whereby it is difficult to manufacture the container 1, resulting in high cost. In addition, a large force is exerted on the fingers holding the handle portions 2, whereby the fingers may, in some cases, hurt. Further, the container 1 is inclined if a force holding the handle portions 2 is even slightly weakened, and the held container 1 swings even by slight rolling. Therefore, hot drink or the like contained in the container 1 spills, whereby the clothes of the person become dirty and the person gets burned on the hand.

On the other hand, although in the case of the container 3 shown in FIG. 16, the air layer 4*c* with predetermined spacing L is provided between the inner body portion 4*a* and the outer body portion 4*b*, the air layer 4*c* is in a sealed state. Accordingly, heat conducted to the air layer 4*c* is not radiated but conducted to the outer body portion 4*b*, whereby the outer body portion 4*b* gradually gets hot, thereby to make it impossible to obtain a sufficient heat insulation effect. Since the body portion 4 has a double structure in the container 3, the manufacture thereof is laborious, and a lot of materials are required. In addition, the volume of the container 3 required for containing drink or the like is smaller than that of a container such as the conventional cup. Accordingly, the container 3 must be made large so as to contain a predetermined amount of drink, resulting in significantly high manufacturing cost. Further, subsequent containers cannot be successively stacked in the container 3 in such a manner that one of the containers is put in the other container, so that they are bulky when they are stored and transported, resulting in high cost for storage and transportation, unlike the conventional paper cups. Therefore, the container 3 is not suitable as containers used in a vending machine or a vehicle such as a railroad.

SUMMARY OF THE INVENTION

A first object of the present invention is to provide a heat insulating container through which heat produced when hot drink is contained therein is hardly conducted to the hand of a person who has the container and which is simple in manufacture and is low in manufacturing cost.

A second object of the present invention is to provide a heat insulating container which automatically produces a sufficient heat insulation effect and can be safely held if hot drink is contained therein without raising handle portions as in the conventional container.

A third object of the present invention is to provide a heat insulating container in which subsequent containers can be successively stacked in such a manner that one of the containers is put in the other container so that they are not bulky when they are stored and transported, similarly to the conventional paper cup and which can be suitably used in a vending machine, a vehicle such as a railroad.

A fourth object of the present invention is to provide a container holding member capable of simply holding a container containing hot drink, hot food or the like in such a manner that heat is not conducted to the hand of a person who has the container.

A heat insulating container according to the present invention comprises a container body and a laminated body in which base materials which differ in heat shrinkage percentages are laminated, the base materials in the laminated body being bonded to each other by bonded portions spaced apart from each other, the base material having a high heat shrinkage percentage in the laminated body being mounted with it directed toward an outer surface of the container body.

In the heat insulating container, it is preferable that the container body is composed of a material having a small wall thickness and is formed in such a shape as to shrink toward the bottom.

Furthermore, in the above described laminated body, it is preferable that a portion between the bonded portions bonding the base materials to each other is in an unbonded state, the base material having a low heat shrinkage percentage is composed of a material having a low coefficient of thermal conductivity, and the base material having a low heat shrinkage percentage is subjected to processing for bending.

In a container holding member according to the present invention, a laminated body in which base materials which differ in heat shrinkage percentages are laminated after being bonded to each other by bonded portions spaced apart from each other is provided in a holding member body in a shape corresponding to the external shape of a container, the base material having a high heat shrinkage percentage in the laminated body being positioned on the inner side with it opposed to the container.

In the heat insulating container according to the present invention, if hot drink or the like is contained in the container body, heat from the contents is conducted through the container body to the laminated body mounted on the outer surface of the container body. Therefore, the base material having a high heat shrinkage percentage positioned with it directed toward the outer surface of the container body shrinks more greatly than the base material having a low heat shrinkage percentage, whereby the base material having a high heat shrinkage percentage is shorter than the base material having a low heat shrinkage percentage. Consequently, the base material having a low heat shrinkage percentage is raised from the base material having a high heat shrinkage percentage in the portion between the bonded portions bonding the base materials to each other.

As a result, the heat from the contents is not directly conducted through the container body to a raised portion of the base material having a low heat shrinkage percentage, and the heat is radiated outward through a space between the raised portion and the base material having a high heat shrinkage percentage. Therefore, there is little possibility that the heat is conducted to the raised portion of the base material having a low heat shrinkage percentage so that the base material gets hot.

Therefore, if a person has the raised portion in his or her hand, the heat from the contents contained in the container body is hardly conducted to the hand, whereby it is not necessary to raise the handle portions as in the container shown in FIG. 14, thereby to make it possible to simply hold the container containing hot drink or the like.

Additionally, if the person thus has the raised portion in his or her hand, it is possible to stably hold the container by a smaller force than that in a case where the person holds the container with the handle portions in his or her hand.

Furthermore, the above described laminated body is mounted in a flat state on the outer surface of the container body until hot drink or the like is supplied to the container body. Therefore, subsequent containers can be successively stacked in the container in such a manner that one of the containers is put in the other container, so that they are not bulky when they are stored and transported.

Additionally, in the container holding member according to the present invention, if the container is contained in the holding member body in a shape corresponding to the external shape of the container and hot drink or the like is supplied to the container in this state, the base material having a high heat shrinkage percentage in the laminated body provided for the holding member body shrinks more greatly than that in the base material having a low heat shrinkage percentage, whereby the base material having a low heat shrinkage percentage is raised from the base material having a high heat shrinkage percentage in a portion between the bonded portions bonding the base materials to each other. If a person holds the container with the raised portion in his or her hand, the container containing hot drink or the like can be simply held.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1A:
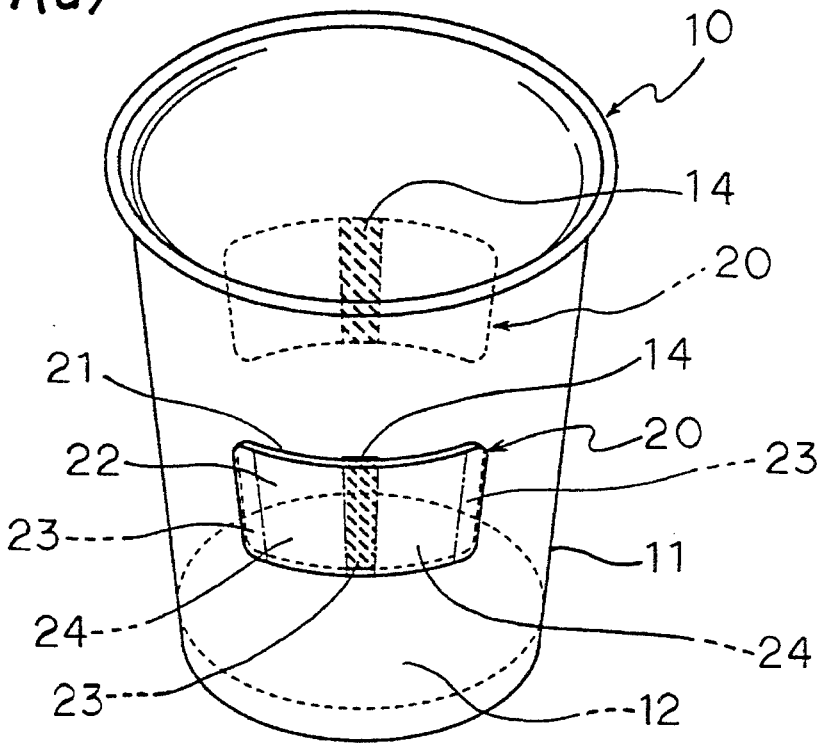
FIGS. 1 (*a*) and 1 (*b*) illustrate one embodiment of a heat insulating container according to the present invention, where FIG. 1 (*a*) is a perspective view showing the heat insulating container, and FIG. 1 (*b*) is a cross sectional view showing the heat insulating container.
Figure 1B:
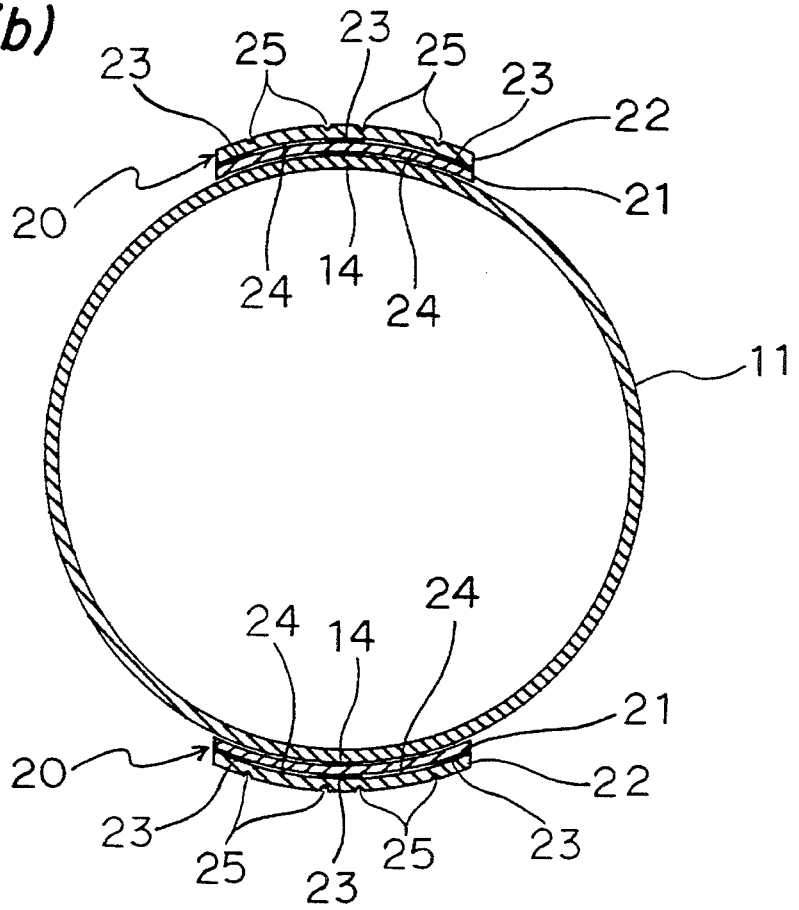

In a heat insulating container according to an embodiment 1, a cup 10 made of paper in which the bottom 12 of a body portion 11 in the shape of an inverted truncated conical cylinder is closed is used as a container body 10, and a pair of laminated bodies 20 is mounted on an outer surface of the body portion 11 in the cup 10 with the body portion 11 interposed therebetween, as shown in FIGS. 1 (*a*) and 1 (*b*).

Figure 2A:
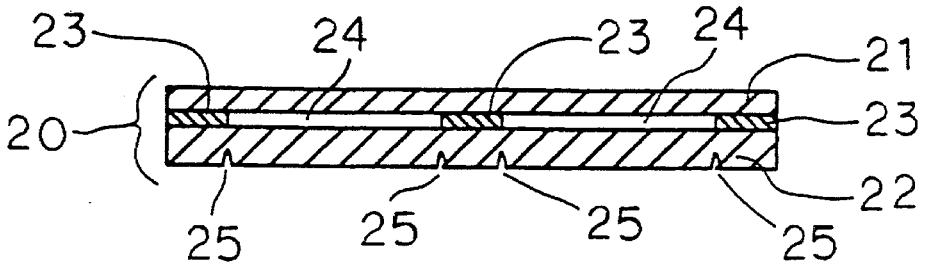
FIGS. 2 (*a*) and 2 (*b*) illustrate a laminated body used for the heat insulating container according to the present embodiment, where FIG. 2 (*a*) is a cross sectional view showing the laminated body, and FIG. 2 (*b*) is a front view showing the laminated body.
Figure 2B:
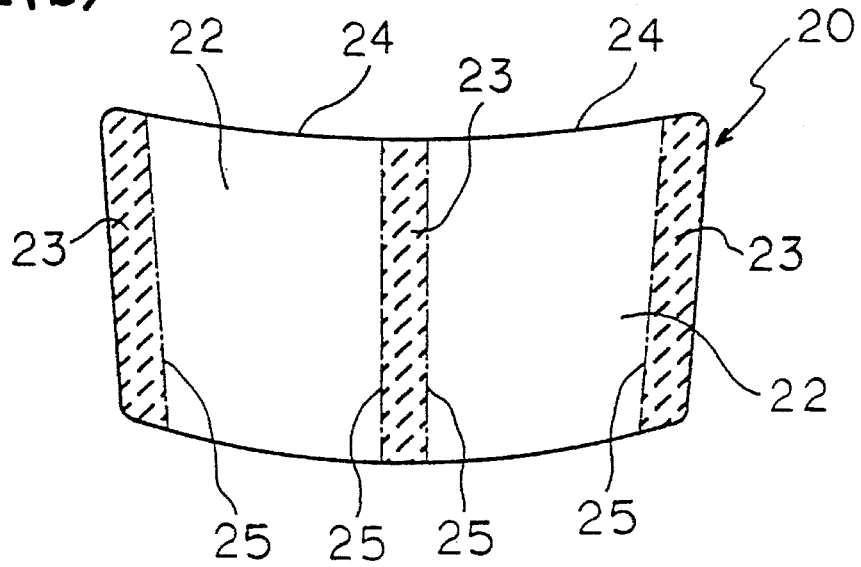

The above described laminated body 20 has a structure in which two types of base materials 21 and 22 which differ in heat shrinkage percentages are laminated, as shown in FIGS. 2 (*a*) and 2 (*b*). The base material 21 having a high heat shrinkage percentage is composed of a heat shrinkable film which is a uniaxial oriented polyvinyl chloride film having a thickness of 30 μm, and the base material 22 having a low heat shrinkage percentage is composed of a mount which is kraft board paper weighing 210 g/m$^2$.

The heat shrinkable film 21 and the mount 22 are bonded to each other in a strip shape with heat resistant adhesives in both ends and the center of the laminated body 20. Two unbonded portions 24 where the heat shrinkable film 21 and the mount 22 are not bonded to each other exist between the three bonded portions 23 in a strip shape. Further, lines for bending 25 are provided along boundary lines between the bonded portions 23 and the unbonded portions 24 in the mount 22 having a low heat shrinkage percentage.

In mounting the laminated body 20 on an outer surface of the body portion 11 in the cup 10, the strip-shaped bonded portions 23 in the laminated body 20 are directed toward the axis of the body portion 11, and the center of the heat shrinkable film 21 is bonded in a strip shape to the outer surface of the body portion 11 along the axis of the body portion 11 with heat resistant adhesives 14.

Figure 3:
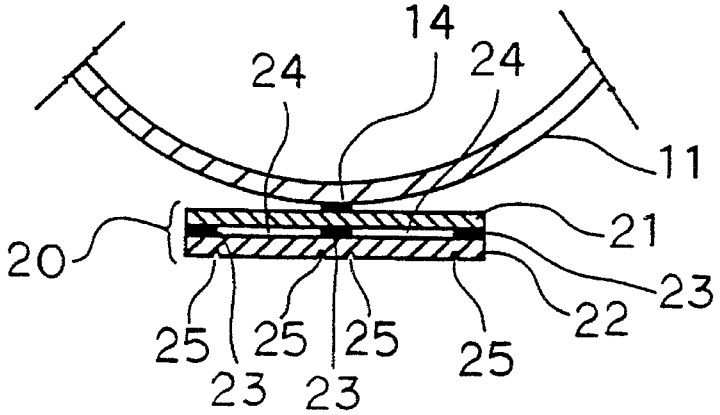
FIG. 3 is a partially sectional view showing a state where the laminated body is mounted on an outer surface of the container body in the heat insulating container according to the present embodiment.
Figure 4A:
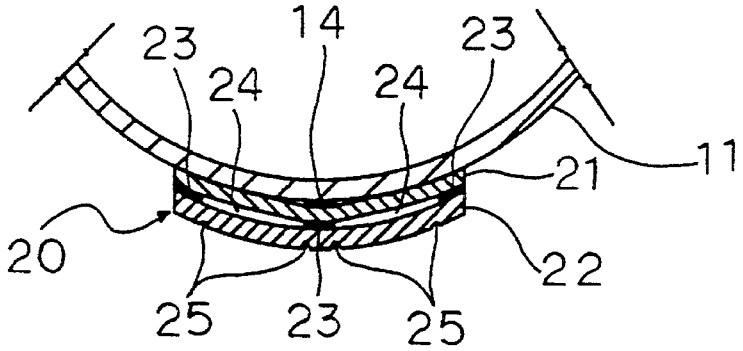
FIGS. 4 (*a*) to 4 (*d*) are cross sectional views showing the processes in which the laminated body mounted on the outer surface of the container body is deformed by heat in the heat insulating container according to the present embodiment.
Figure 4B:
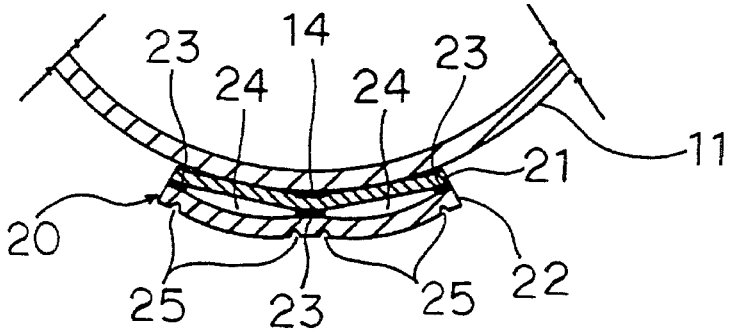
Figure 4C:
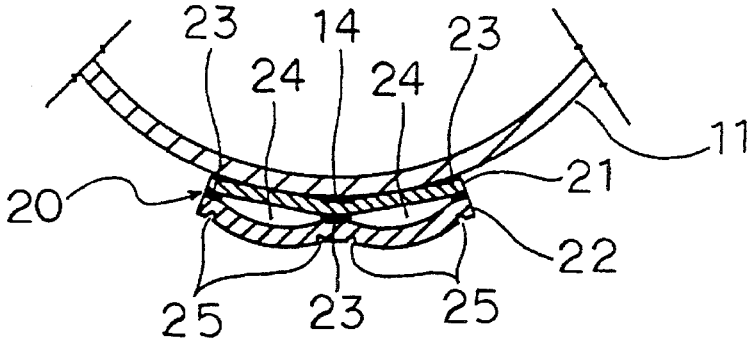
Figure 4D:
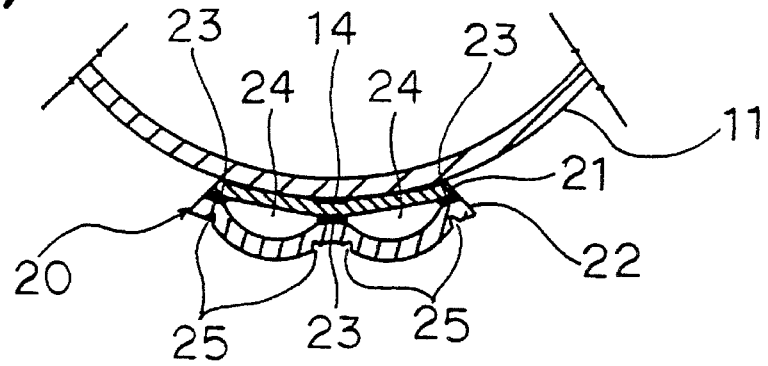
Figure 5A:
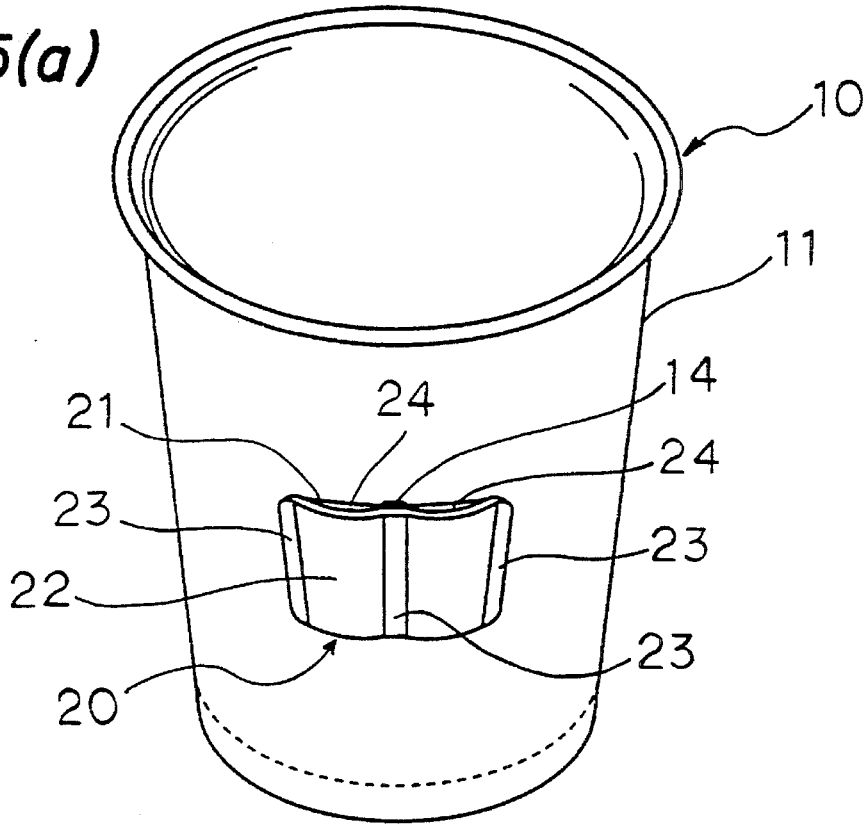
FIGS. 5 (*a*) and 5 (*b*) illustrate the state of the heat insulating container after the laminated body is deformed by heat in the present embodiment, where FIG. 5 (*a*) is a perspective view with the laminated body directed toward the front surface, and FIG. 5 (*b*) is a perspective view with the laminated body directed toward the side surface.
Figure 5B:
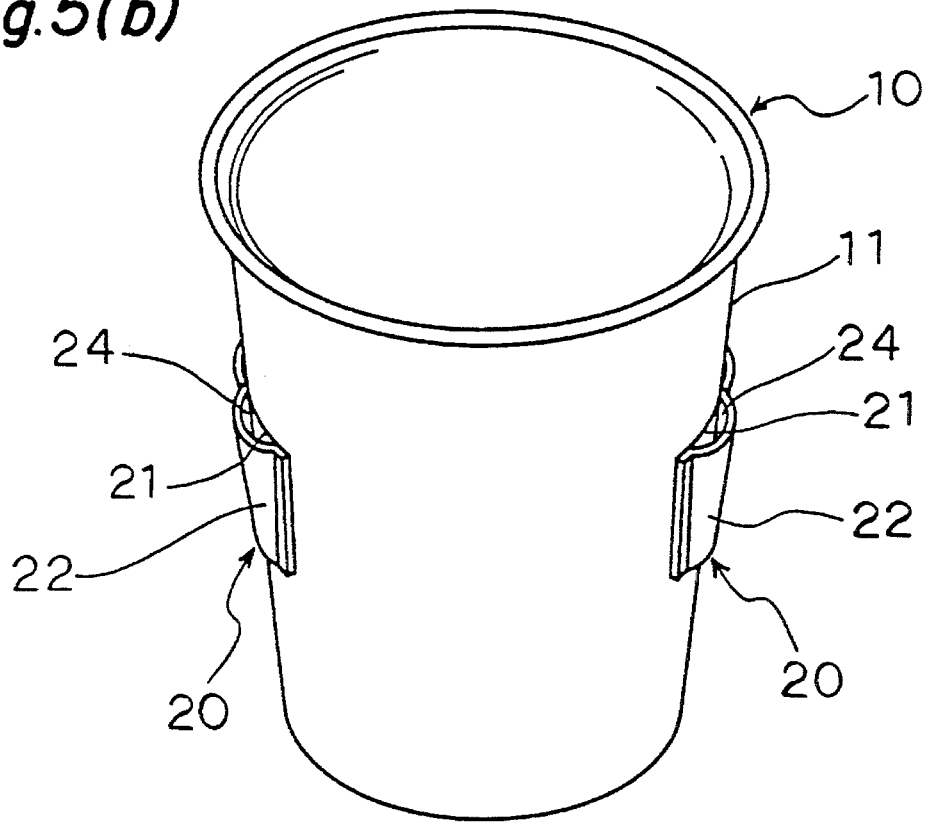

If only the center of the heat shrinkable film 21 having a high heat shrinkage percentage is thus bonded to the outer surface of the body portion 11, both the ends of the laminated body 20 in the circumferential direction of the body portion 11 are in a state where they are spaced apart from the body portion 11, as shown in FIG. 3. If both the ends of the laminated body 20 are in a state where they are spaced apart from the body portion 11, heat produced when drink at a high temperature such as hot coffee is supplied to the cup 10 is not sufficiently conducted to the whole of the heat shrinkable film 21. Therefore, the shrinkage of the heat shrinkable film 21 may, in some cases, be delayed or non-uniform.

In the present embodiment, therefore, the laminated body 20 is mounted on the outer surface of the body portion 11 in the cup 10 as described above, after which hot air at temperatures around 50° C. is sprayed on the laminated body 20, to heat the laminated body 20. If the laminated body 20 is thus heated, the heat shrinkable film 21 having a high heat shrinkage percentage shrinks, and the mount 22 is bend toward the heat shrinkable film 21, whereby the laminated body 20 is in a state where it is brought into close contact with the outer surface of the body portion 11. However, a method of bringing both the ends of the laminated body 20 into close contact with the outer surface of the body portion 11 is not limited to the foregoing method. For example, it is possible to use some methods such as a method of temporarily bonding both the ends of the laminated body 20 spaced apart from the outer surface of the body portion 11 to the outer surface of the body portion 11 at pinpoints with thermosoftening adhesives which are softened at temperatures around 50° to 60° C. so that the thermosoftening adhesives melt if drink at a high temperature or the like is supplied to the cup 10. However, both the ends of the laminated body 20 need not be necessarily brought into close contact with the outer surface of the body portion 11. If drink at a high temperature or the like is supplied to the cup 10, the mount 22 is bent toward the heat shrinkable film 21 by the shrinkage of the heat shrinkable film 21, whereby both the ends of the laminated body 20 are brought into close contact with the outer surface of the body portion 11, as described later.

If drink at a high temperature such as hot coffee or hot soup is supplied to the cup 10 in which the laminated body 20 is mounted on the outer surface of the body portion 11 as described above, heat from the drink is conducted to the heat shrinkable film 21 in the laminated body 20 through the body portion 11. If the heat shrinkable film 21 is heated to temperatures of not less than 50° C., the heat shrinkable film 21 starts to gradually shrink. If the heat is further conducted so that the temperature of the heat shrinkable film 21 reaches around 60° to 70° C., the heat shrinkable film 21 gradually shrinks, whereby the laminated body 20 is deformed as shown in FIGS. 4 (*a*) to 4 (*d*).

The processes in which the heat shrinkable film 21 shrinks to deform the laminated body 20 will be described more specifically. Only the center of the heat shrinkable film 21 is bonded to the outer surface of the body portion 11, and both the ends thereof are not fixed to the body portion 11, as described above. Accordingly, both the ends of the heat shrinkable film 21 shrink toward the center thereof. On the other hand, the mount 22 hardly shrinks because the heat shrinkage percentage thereof is very low. Consequently, the mount 22 is in a state where it is slightly raised from the heat shrinkable film 21 in the unbonded portions 24 where the mount 22 is not bonded to the heat shrinkable film 21, as shown in FIG. 4 (*a*), due to the difference in shrinkage from the heat shrinkable film 21.

If the heat shrinkable film 21 is further heated, the mount 22 is bent in portions of the lines for bending 25 by the shrinkage of the heat shrinkable film 21, and the heat shrinkable film 21 further shrinks toward the center thereof while both the ends thereof are pressed against the outer surface of the body portion 11 by the mount 22, whereby the mount 22 is further raised from the heat shrinkable film 21 in the unbonded portions 24, to form two series of tunnel-shaped spaces between the heat shrinkable film 21 and the mount 22, as shown in FIGS. 4 (*b*) to 4 (*d*). If the rigidity of the mount 22 is extremely higher than the shrinkage force of the heat shrinkable film 21, the shrinkage of the heat shrinkable film 21 is restrained by the mount 22, whereby the above described spaces are not satisfactorily formed. Accordingly, the base materials 21 and 22 which differ in heat shrinkage percentages constituting the laminated body 20 must be suitably selected.

In the embodiment, a uniaxial oriented polyvinyl chloride film which has a high heat shrinkage percentage and has a great shrinkage force and kraft board paper weighing 210 g/cm$^2$ which is relatively thin, has low rigidity and has a significantly low heat shrinkage percentage are respectively used as the two types of base materials 21 and 22 which differ in heat shrinkage percentages constituting the laminated body 20, and the lines for bending 25 are provided in the mount 22 along the boundary lines between the bonded portions 23 bonding the heat shrinkable film 21 and the mount 22 to each other and the unbonded portions 24. If drink at a high temperature or the like is supplied to the cup 10, therefore, the heat shrinkable film 21 quickly shrinks, whereby the mount 22 is raised from the heat shrinkable film 21 in the unbonded portions 24, to quickly form two series of tunnel-shaped spaces between the mount 22 and the heat shrinkable film 21.

If two series of tunnel-shaped spaces are quickly formed between the mount 22 and the heat shrinkable film 21, heat conducted to the heat shrinkable film 21 through the cup 10 is not directly conducted to the mount 22 in a raised state. In addition, the heat is radiated outward by air passing through the spaces. Therefore, a portion of the mount 22 in a raised state does not get hot.

Even when boiling drink or the like is supplied to the cup 10, therefore, if a person has the raised portion of the mount 22 in his or her hand, the hand does not get hot.

Furthermore, the portion of the mount 22 raised from the heat shrinkable film 21 has an arch structure dynamically stable, as shown in FIGS. 4 (*d*), 5 (*a*) and 5 (*b*). Accordingly, the raised portion of the mount 22 has sufficient structural strength when it is held in the hand irrespective of the fact that the mount 22 is relatively thin and is low in rigidity as described above. As a result, even when the cup 10 which becomes heavy because it contains drink or the like is held, the raised portion of the mount 22 is not concaved. Accordingly, the tunnel-shaped spaces are maintained, so that the hand does not get hot.

Furthermore, in the present embodiment, the pair of laminated bodies 20 is provided on the outer surface of the body portion 11 in the cup 10 with the body portion 11 interposed therebetween, and the person holds the cup 10 with the raised portions of the mounts 22 in the pair of laminated bodies 20 in his or her hand. Accordingly, the cup 10 can be stably held by a smaller force, as compared with a case where the person holds the cup 10 with the handle portions in his or her hand. The held cup 10 does not greatly swing by the rolling or the like. Accordingly, there is no possibility that hot drink in the cup 10 spills so that the clothes of the person becomes dirty and the person gets burned on the hand. Therefore, the person can safely have hot drink.

Although description was made of a case where hot drink or the like is supplied to the cup 10, the same is true for a case where retort pouch food or the like is contained in the cup 10 and heated by an electronic oven or the like. Specifically, the mount 22 is raised from the heat shrinkable film 21 in the unbonded portions 24 to form tunnel-shaped spaces. Also in this case, the hand of a person who holds the cup 10 does not get hot.

Although in the present embodiment, a uniaxial oriented polyvinyl chloride film having a thickness of 30 μm is used as the base material 21 having a high heat shrinkage percentage in the laminated body 20, the base material 21 is not limited to the same. For example, it is also possible to use another heat shrinkable film made of synthetic resin such as a polyethylene film, a biaxial oriented heat shrinkable film, a heat shrinkable film having a thickness of approximately 50 μm, and the like.

On the other hand, the base material 22 having a low heat shrinkage percentage in the laminated body 20 is not also limited to kraft board paper weighing 210 g/m$^2$. Another paper material, a sheet made of synthetic resin, and the like can be used, provided that it greatly differs in heat shrinkage percentages from the base material 21 having a high heat shrinkage percentage and it is raised when the base material 21 having a high heat shrinkage percentage shrinks.

Figure 6:
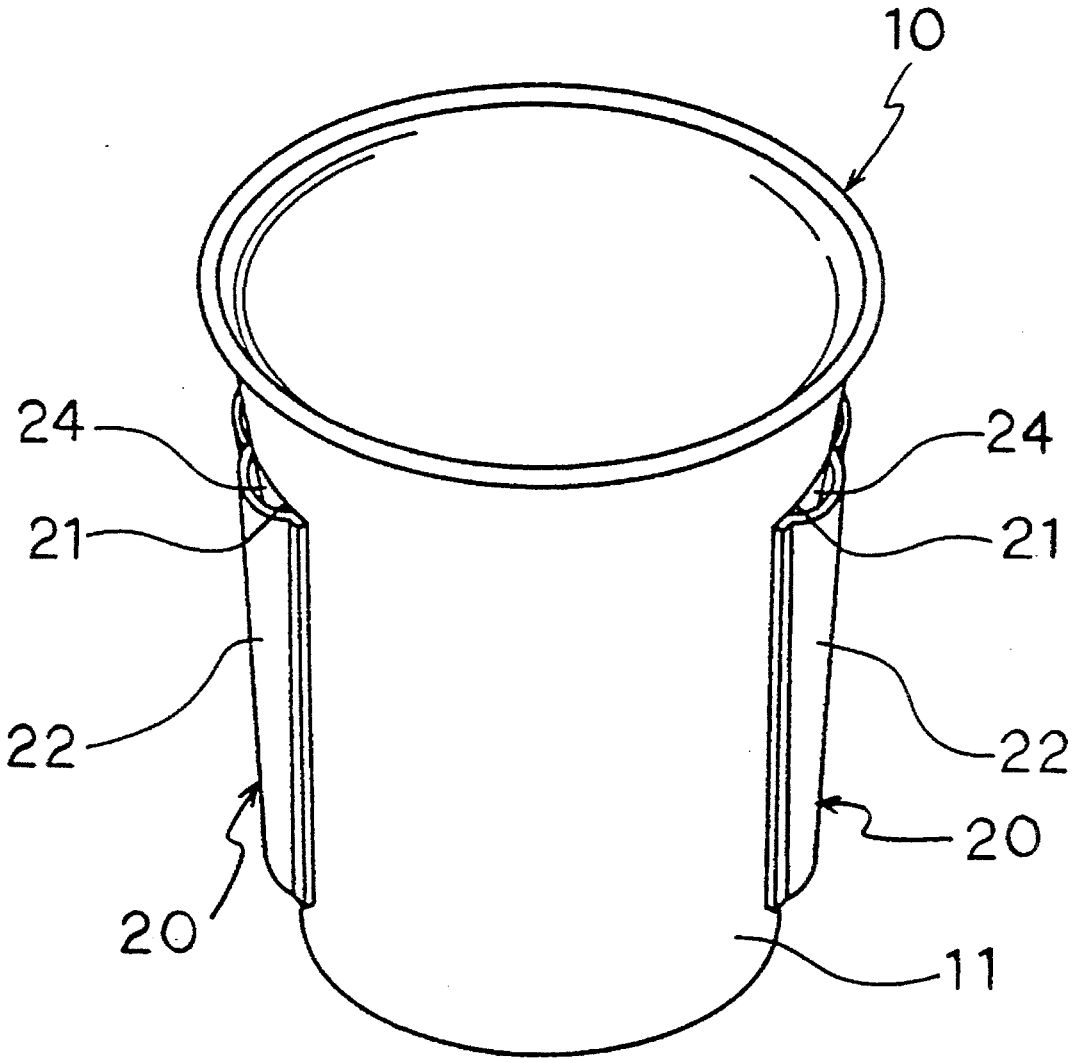
FIG. 6 is a perspective view showing, in the heat insulating container according to the present embodiment on which laminated bodies having a large area are mounted, a state where the laminated bodies are deformed by heat.

Although in the present embodiment, a pair of laminated bodies 20 is provided on the outer surface of the body portion 11 in the cup 10 with the body portion 11 interposed therebetween, laminated bodies 20 can be provided in more portions. In addition, the size of the laminated body 20 is not particularly limited. For example, the laminated body 20 having a large area can be used, as shown in FIG. 6. In this case, if drink at a high temperature or the like is supplied to the cup 10 as described above, the mount 22 is raised from the heat shrinkable film 21 in the unbonded portions 24, to form two series of long tunnel-shaped spaces.

Although in the above described laminated body 20, the heat shrinkable film 21 and the mount 22 which differ in heat shrinkage percentages are bonded to each other in a strip shape in the three portions, that is, both the ends and the center of the laminated body 20, the number of bonded portions 23 is not limited, and the shape of the bonded portions 23 is not limited to the strip shape.

Figure 7A:
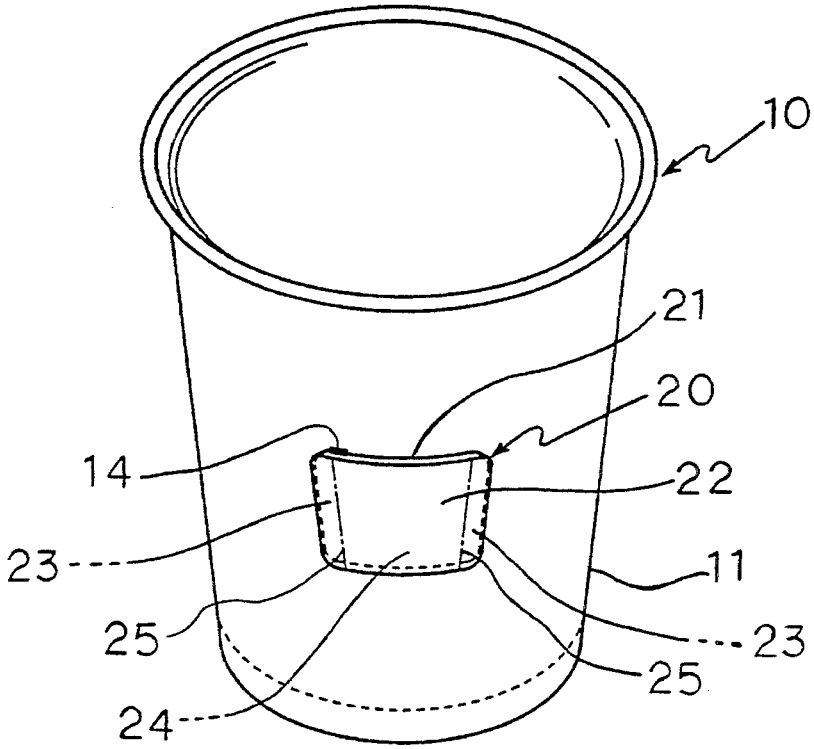
FIGS. 7 (*a*) to 7 (*c*) illustrate a heat insulating container according to another embodiment of the present invention, where FIG. 7 (*a*) is a perspective view showing the heat insulating container, FIG. 7 (*b*) is a cross sectional view showing a laminated body, and FIG. 7 (*c*) is a front view showing the laminated body.
Figure 7B:
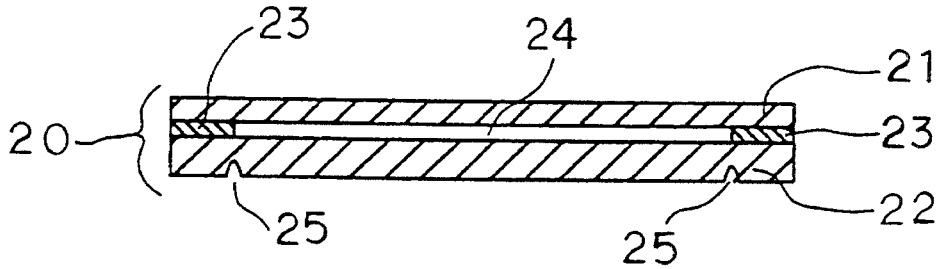
Figure 7C:
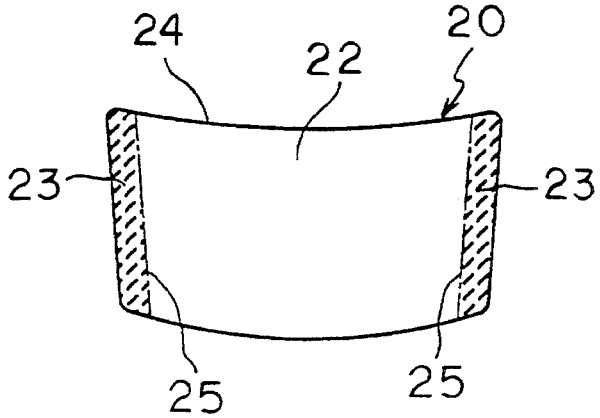

In a heat insulating container according to an embodiment 2, a heat shrinkable film and a mount which are the same as those in the above described embodiment 1 are respectively used as base materials 21 and 22 which differ in heat shrinkage percentages constituting a laminated body 20. In the laminated body 20, the heat shrinkable film 21 and the mount 22 are bonded to each other in a strip shape in both its ends, one unbonded portion 24 is formed between bonded portions 23 in both the ends, and lines for bending 25 are provided in the mount 22 along boundary lines between the bonded portions 23 and the unbonded portion 24, as shown in FIGS. 7 (*a*) to 7 (*b*).

The strip-shaped bonded portions 23 in the laminated body 20 are directed toward the axis of a body portion 11 in a cup 10, and one of the ends of the heat shrinkable film 21 is bonded in a strip shape to the outer surface of the body portion 11 along the axis of the body portion 11 with heat resistant adhesives 14. Also in the present embodiment, a pair of laminated bodies 20 is provided on the outer surface of the body portion 11 with the body portion 11 interposed therebetween, as in the above described embodiment 1.

If hot drink is supplied to the cup 10 which is provided with the laminated bodies 20, the heat shrinkable film 21 shrinks toward the end thereof which is bonded to the outer surface of the body portion 11 while the end thereof which is not bonded to the outer surface of the body portion 11 is pressed against the body portion 11 by the mount 22, while the mount 22 is bent in portions of the lines for bending 25 without shrinking. Therefore, the mount 22 is raised from the heat shrinkable film 21 in the unbonded portion 24, to form one tunnel-shaped space.

If a person has the raised portion of the mount 22 in his or her hand, the hand does not get hot, thereby to make it possible to stably hold the cup 10, as in the above described embodiment 1.

Figure 8A:
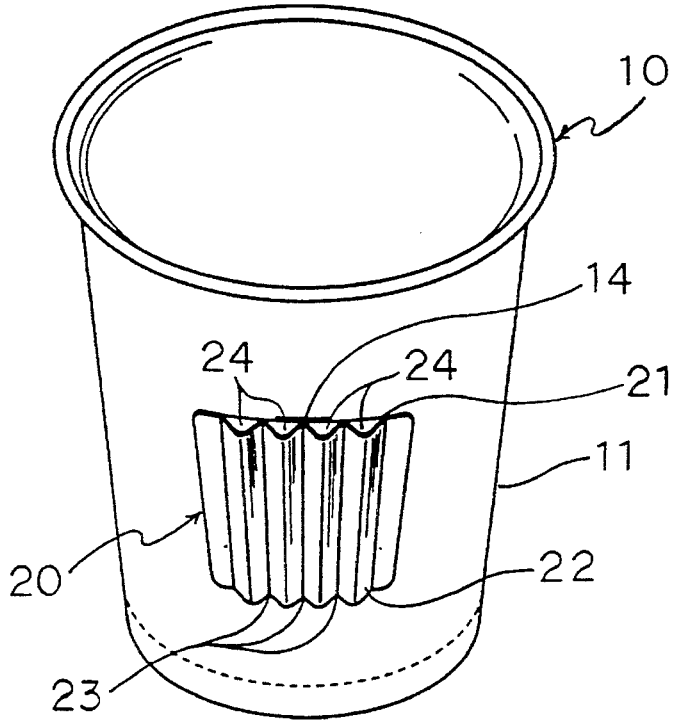
FIGS. 8 (*a*) to 8 (*c*) illustrate a heat insulating container according to still another embodiment of the present invention, where FIG. 8 (*a*) is a perspective view showing the state of the heat insulating container after a laminated body is deformed by heat, FIG. 8 (*b*) is a front view showing the laminated body, and FIG. 8 (*c*) is a cross sectional view showing the laminated body.
Figure 8B:
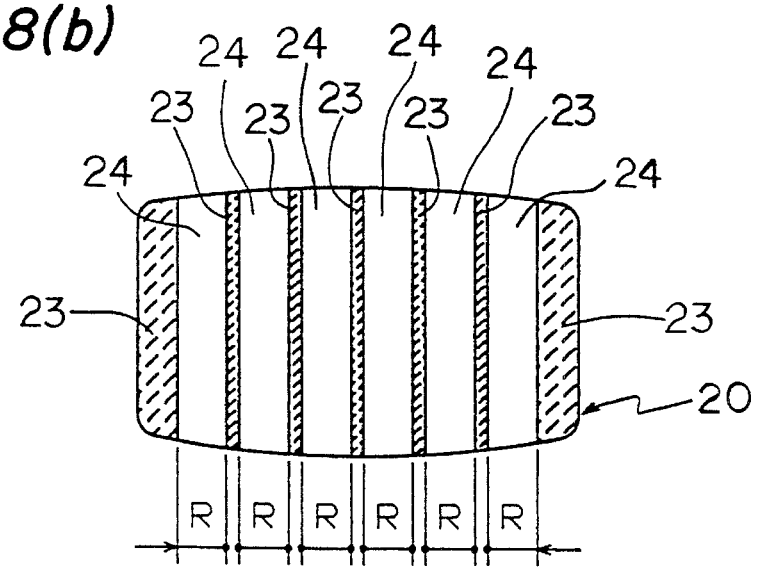
Figure 8C:
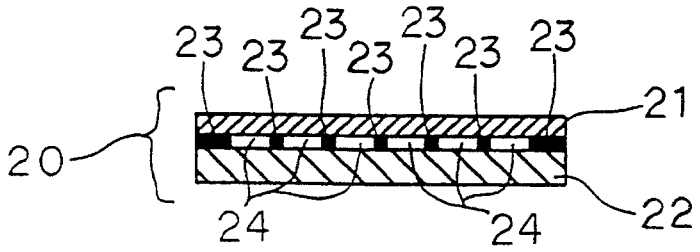

In a heat insulating container according to an embodiment 3, the same heat shrinkable film as those in the above described embodiments 1 and 2 is used as a base material 21 having a high heat shrinkage percentage in a laminated body 20, while a mount composed of bleached kraft pulp weighing 70 g/m$^2$ is used as a base material 22 having a low heat shrinkage percentage. In the laminated body 20, the heat shrinkable film 21 and the mount 22 are bonded to each other in a lot of bonded portions 23 in a strip shape, to from a lot of unbonded portions 24 between the bonded portions 23, as shown in FIGS. 8 (*a*) to 8 (*c*).

The strip-shaped bonded portions 23 in both ends of the laminated body 20 are relatively wide, and each of the bonded portions 23 in a strip shape therebetween is relatively narrow. The width R of the unbonded portion 24 between the bonded portions 23 is approximately 6 to 7 mm, which is made smaller than that in the laminated bodies 20 in the above described embodiments 1 and 2. In the laminated body 20, no lines for bending 25 are provided in the mount 22.

The strip-shaped bonded portions 23 in the laminated body 20 are directed toward the axis of a body portion 11 in a cup 10, and the center of the heat shrinkable film 21 is bonded in a strip shape to an outer surface of the body portion 11 along the axis of the body portion 11 with heat resistant adhesives 14. Also in the present embodiment, a pair of laminated bodies 20 is provided on the outer surface of the body portion 11 with the body portion 11 interposed therebetween.

If hot drink is supplied to the cup 10 which is provided with the laminated bodies 20, the heat shrinkable film 21 shrinks toward the center while both the ends thereof which are not bonded to the outer surface of the body portion 11 are pressed against the outer surface of the body portion 11 by the mount 22, while the mount 22 does not shrink. Therefore, the mount 22 is raised from the heat shrinkable film 21 in the respective unbonded portions 24 due to the difference in shrinkage from the heat shrinkable film 21, to quickly form a lot of tunnel-shaped spaces between the mount 22 and the thermal shrinkable film 21.

If a person has the raised portion of the mount 22 in his or her hand, the hand does not get hot, thereby to make it possible to stably hold the cup 10, as in the above described embodiments 1 and 2.

If a mount being very thin and having suitable rigidity is used as the base material 22 having a low heat shrinkage percentage as in the present embodiment, the mount 22 is quickly raised from the heat shrinkable film 21 in the unbonded portions 24 by the shrinkage force of the heat shrinkable film 21, thereby to quickly form a lot of tunnel-shaped spaces even if the lines for bending 25 as described in the embodiments 1 and 2 are not provided. Furthermore, if the lines for bending 25 are not provided in the mount 22, the manufacturing processes of the laminated body 20 are simplified, thereby to reduce the manufacturing cost. In order to raise the mount 22 more quickly, however, it is possible to provide the lines for bending 25 in the mount 22.

Although in the above described embodiments 1 to 3, the strip-shaped bonded portions 23 in the laminated body 20 are directed toward the axis of the body portion 11 in the cup 10 to mount the laminated body 20 on the body portion 11 so that the tunnel-shaped spaces are formed along the axis of the body portion 11, the strip-shaped bonded portions 23 in the laminated body 20 may be mounted with they inclined to the axis of the body portion 11 so that the tunnel-shaped spaces are formed so as to be inclined to the axis of the body portion 11. In such a manner, when a person holds the cup 10 with the raised portion of the mount 22 in his or her hand, resistance between the raised portion of the mount 22 and the hand is increased, thereby to prevent the cup 10 from being dropped from the hand.

Figure 9:
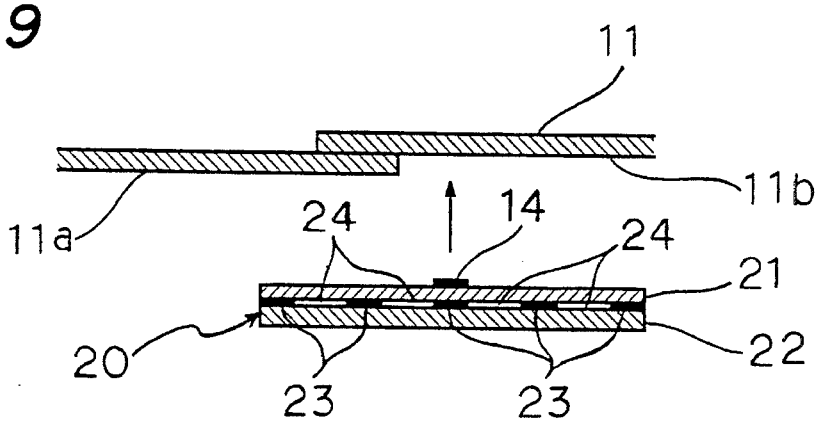
FIG. 9 is a partially sectional view showing an example in which a laminated body is mounted on a cup in which a part of a body portion has a double structure.
Figure 10A:
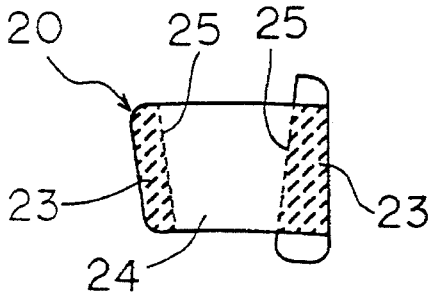
FIGS. 10 (*a*) to 10 (*e*) are front views showing examples of the laminated body used for the heat insulating container according to the present invention.
Figure 10B:
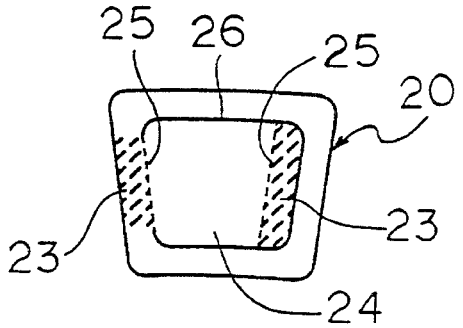
Figure 10C:
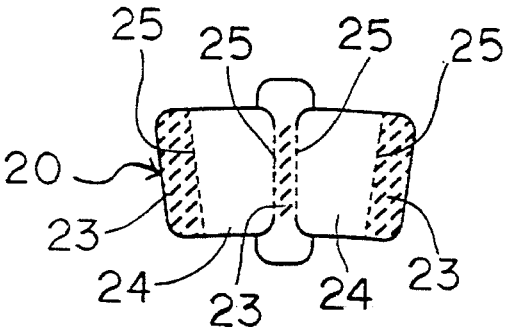
Figure 10D:
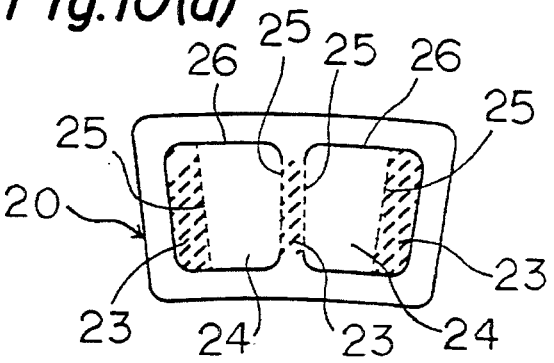
Figure 10E:
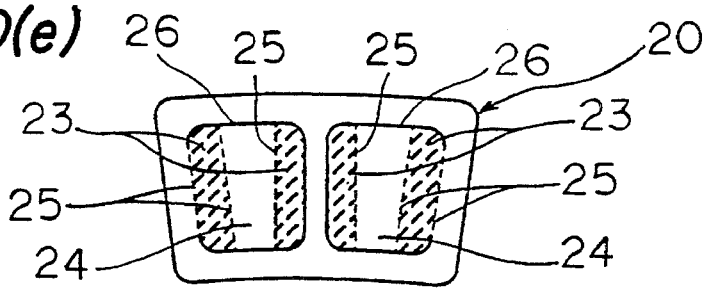

Furthermore, as shown in FIG. 9, in mounting a laminated body 20 on a cup 10 in which a part of a body portion 11 has a double structure, if a heat shrinkable film 21 in the laminated body 20 is bonded to an outer part 11*a* of the double body portion 11, heat is not sufficiently conducted to the heat shrinkable film 21. Accordingly, the shrinkage of the heat shrinkable film 21 may, in some cases, be nonuniform so that tunnel-shaped spaces are not satisfactorily formed. Consequently, it is preferable to bond the heat shrinkable film 21 on an inner part 11*b* of the double body portion 11.

The laminated body 20 used in the heat insulating container according to the present invention is not limited to those shown in the above described embodiments 1 to 3. For example, it is possible to use various laminated bodies 20 as shown in FIGS. 10 (*a*) to 10 (*e*) and FIGS. 11 (*a*) to 11 (*c*).

A laminated body 20 shown in FIG. 10 (*a*) is in such a shape that an end, which is mounted on a body portion 11 in a cup 10, of the laminated body 20 used in the embodiment 2 is projected. A laminated body 20 shown in FIG. 10 (*b*) is in such a shape that a notch 26 in a ⊃ shape is provided in its center. In this case, a heat shrinkable film 21 and a mount 22 are bonded to each other in a strip shape with spacing in an opened end of the notch 26 and an end in the notch 26 so that an unbonded portion 24 in the notch 26 is provided, and the heat shrinkable film 21 shrinks in the unbonded portion 24 to raise the mount 22. A laminated body 20 shown in FIG. 10 (*c*) is in such a shape that the center, which is mounted on a body portion 11 in a cup 10, of the laminated body 20 used in the embodiment 1 is projected. A laminated body 20 shown in FIG. 10 (*d*) is in such a shape that notches 26 in a ⊃ shape are provided with opened ends of the respective notches 26 opposed to each other on both sides of a bonded portion 23 in its center. In this case, a heat shrinkable film 21 and a mount 22 are bonded to each other in a strip shape in ends on both sides in the notches 26 spaced apart from the bonded portion 23 in the center, and the heat shrinkable film 21 shrinks in unbonded portions 24 in the respective notches 26 to raise the mount 22. A laminated body 20 shown in FIG. 10 (*e*) is in such a shape that notches 26 in a ⊃ shape are provided with opened ends of the respective notches 26 not opposed to each other. In this case, a pair of bonded portions 23 is provided with spacing in each of the notches 26, and the heat shrinkable film 21 shrinks in an unbonded portion 24 in the notch 26 to raise a mount 22.

As shown in FIGS. 10 (*b*), 10 (*d*) and 10 (*e*), in the case of the laminated body 20 so adapted that the notch 26 in a ⊃ shape is provided, and the heat shrinkable film 21 shrinks in the unbonded portion 24 in the notch 26 to raise the mount 22, a portion outside of the notch 26 is so constructed that the heat shrinkable film 21 is bonded to the whole of the mount 22. However, the portion outside of the notch 26 may be constituted by only the mount 22 having a low heat shrinkage percentage. If the portion outside of the notch 26 is so constructed that the heat shrinkable film 21 is bonded to the whole of the mount 22, and this portion is bonded to the body portion 11 in the cup 10, the shrinkage of the heat shrinkable film 21 is restrained by bonding to the mount 22 and the cup 10 even if the heat shrinkable film 21 in this portion is heated. Consequently, the heat shrinkable film 21 shrinks in only the unbonded portion 24 in the notch 26 to raise the mount 22 in this portion, as described above.

Figure 11A:
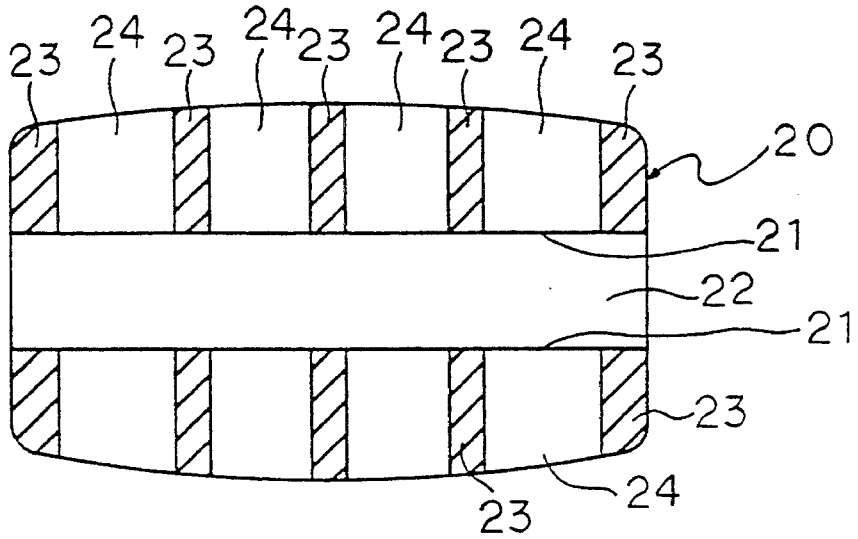
FIGS. 11 (*a*) to 11 (*c*) are front views showing the other examples of the laminated body used for the heat insulating container according to the present invention.
Figure 11B:
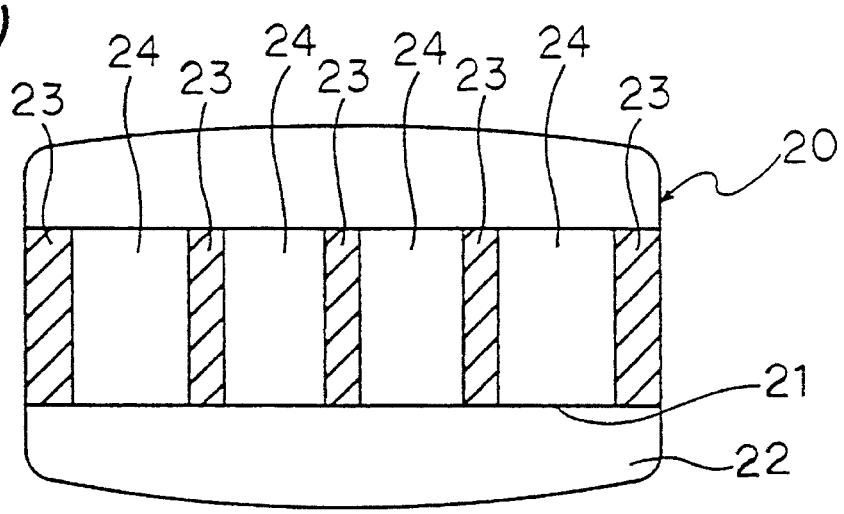
Figure 11C:
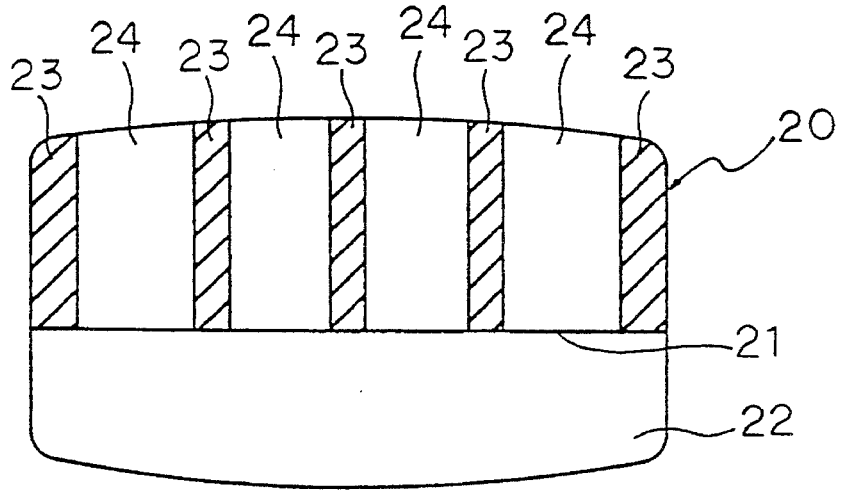

Additionally, in a laminated body 20 shown in FIG. 11 (*a*), heat shrinkable films 21 are laminated on upper and lower parts of a mount 22, and each of the heat shrinkable films 21 is bonded to the mount 22 in strip-shaped bonded portions 22 with required spacing. In a laminated body 20 shown in FIG. 11 (*b*), a heat shrinkable film 21 is laminated in the center of a mount 22, and the heat shrinkable film 21 is bonded to the mount 22 in strip-shaped bonded portions 23 with required spacing. In a laminated body 20 shown in FIG. 11 (*c*), a heat shrinkable film 21 is laminated on an upper part of a mount 22, and the heat shrinkable film 21 is bonded to the mount 22 in strip-shaped bonded portions 23 with required spacing. In each of the laminated bodies 20, the heat shrinkable film 21 shrinks in unbonded portions 24 between the bonded portions 23, to raise the mount 22.

Figure 12:
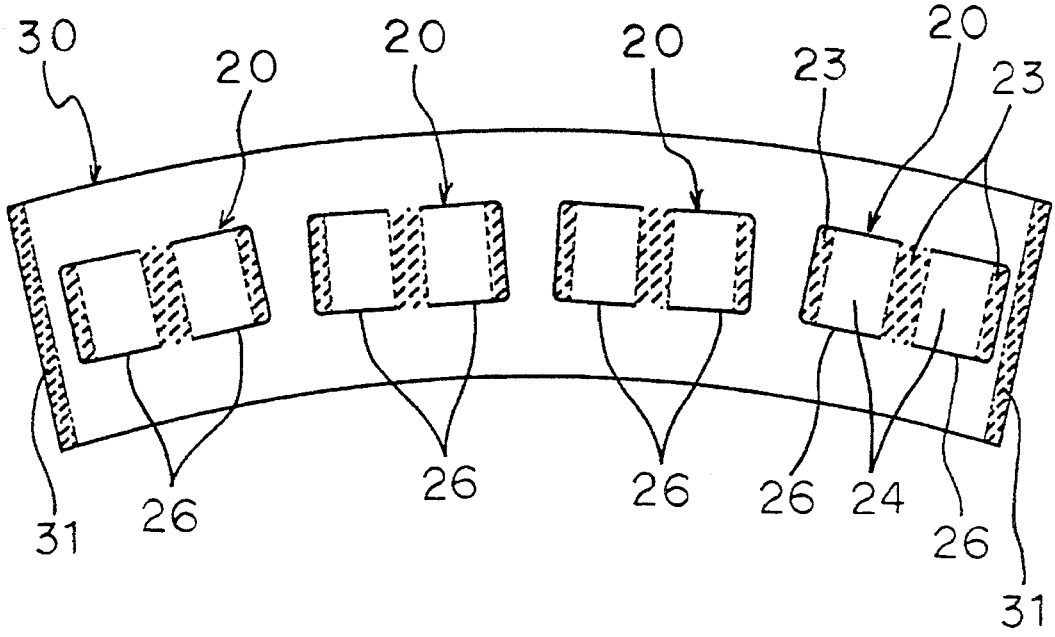
FIG. 12 is an exploded view showing a container holding member according to an embodiment of the present invention.
Figure 13:
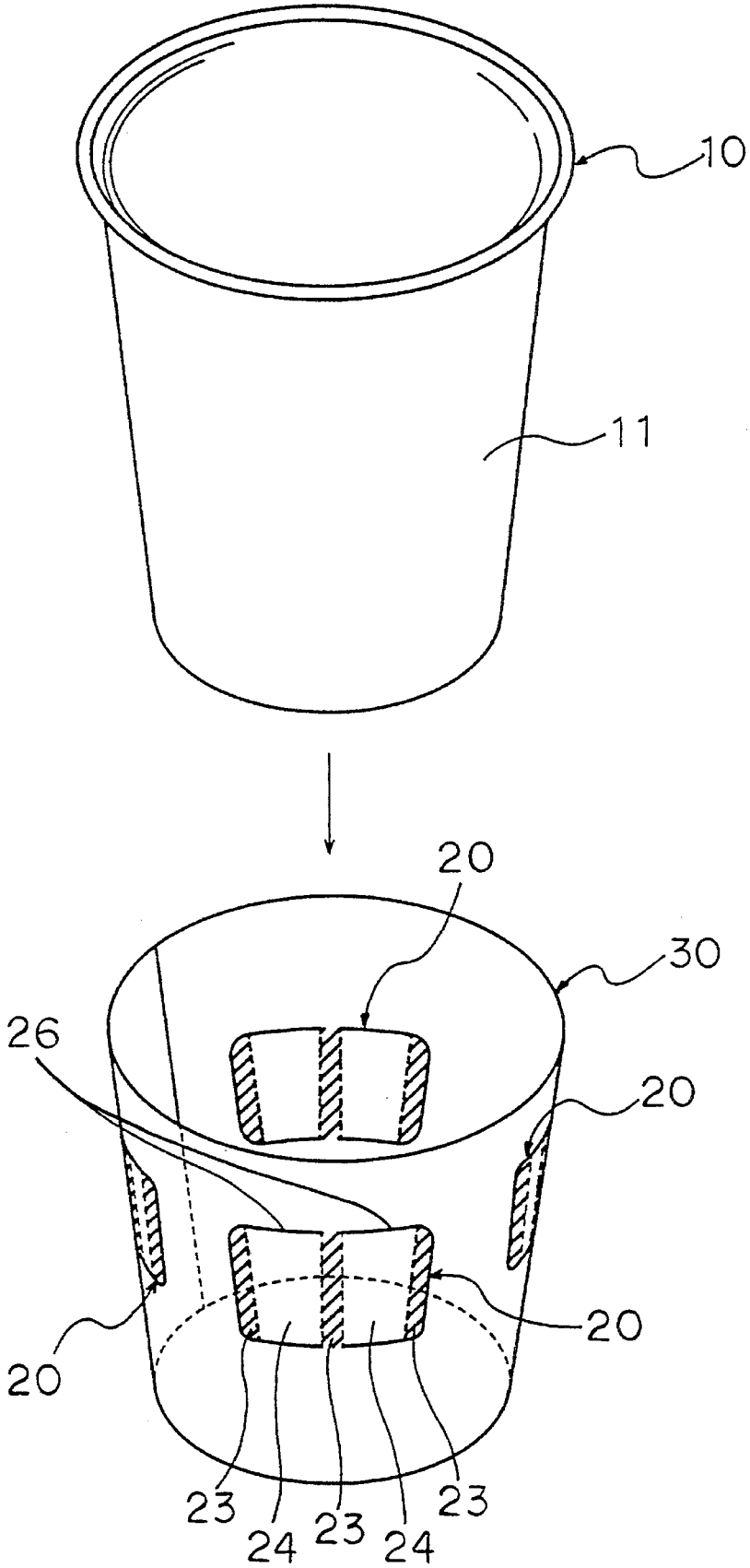
FIG. 13 is a perspective view showing a state where the container is held by the container holding member according to the present embodiment.
Figure 14:
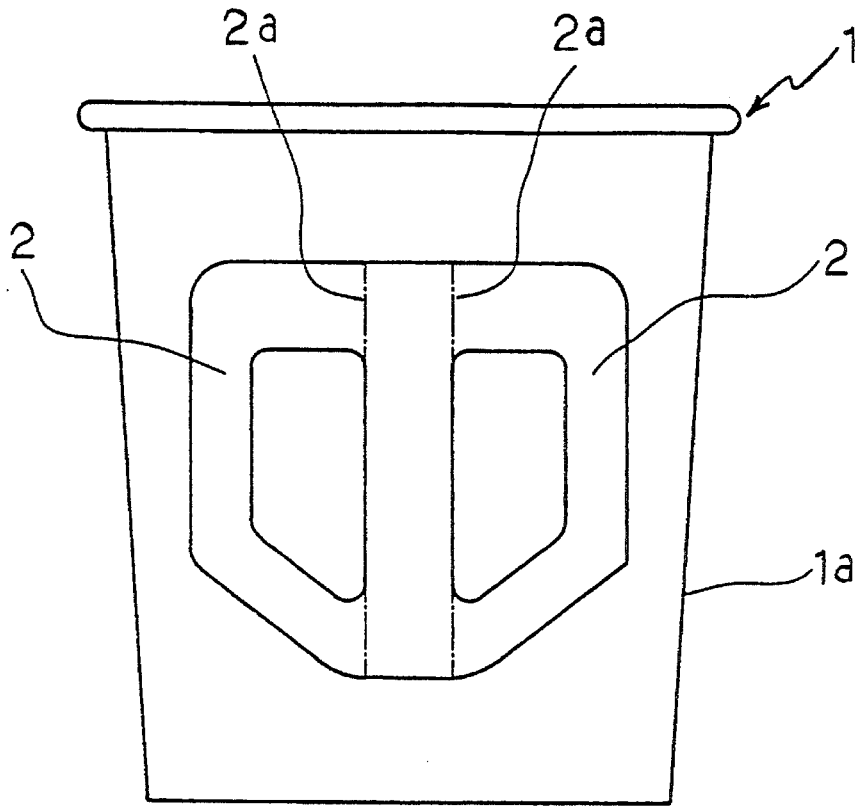
FIG. 14 is a front view showing a conventional container in which handle portions are mounted on an outer surface of a body portion.
Figure 15:
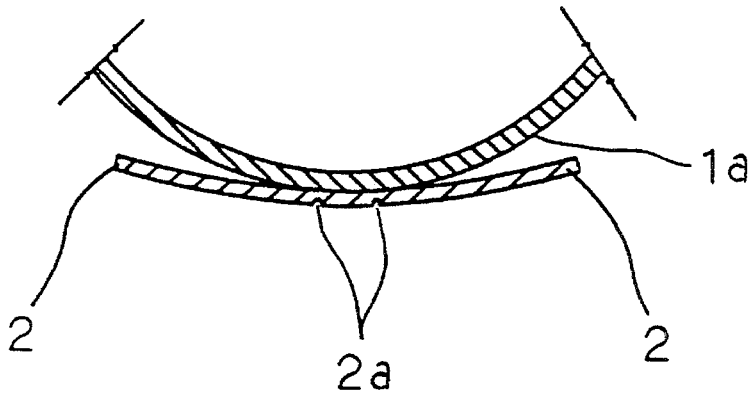
FIG. 15 is a cross sectional view showing a state where the handle portions are mounted on the outer surface of the body portion in the container shown in FIG. 14.
Figure 16:
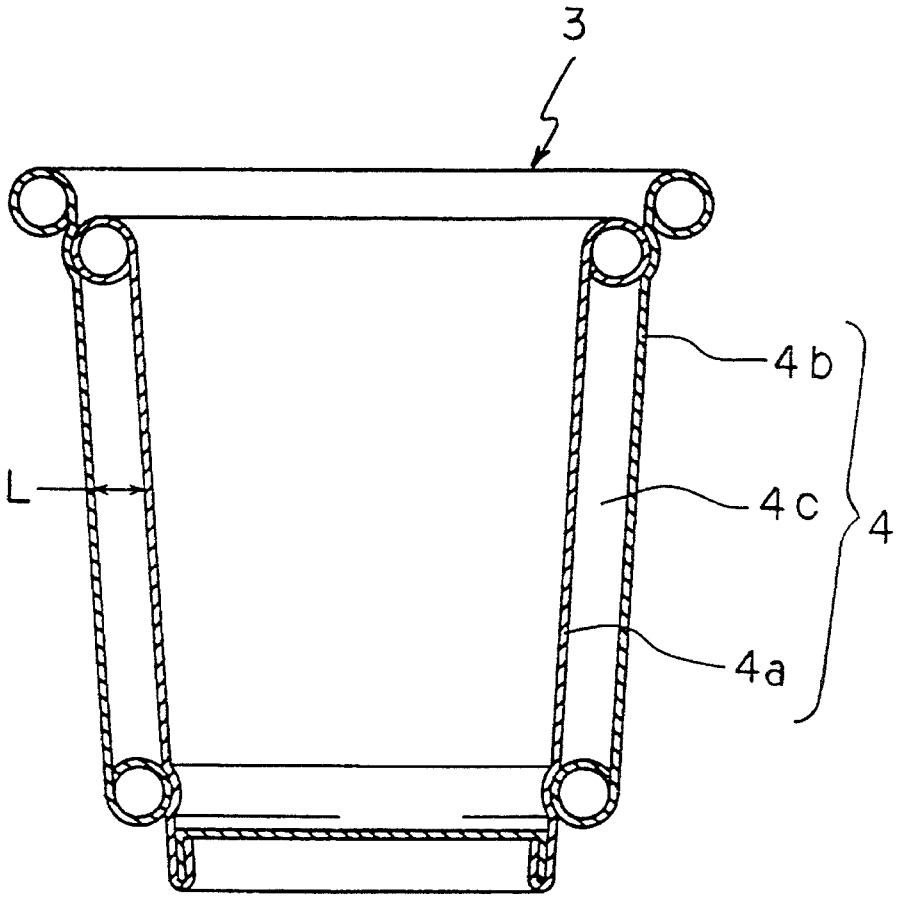
FIG. 16 is a cross sectional view showing a conventional container in which a body portion has a double structure comprising an inner body portion and an outer body portion with an air layer provided therebetween.

FIGS. 12 and 13 show an embodiment of a container holding member according to the present invention.

The container holding member according to the embodiment is formed in the shape of an inverted truncated conical cylinder corresponding to the shape of a body portion 11 in a cup 10 held by a holding member body 30, and the holding member body 30 is provided with a plurality of laminated bodies 20 with suitable spacing with a heat shrinkable film 21 positioned on the inner side. The holding member body 30 is formed in the shape of a strip curved as shown in FIG. 12. In each of the laminated bodies 20, notches 26 in a ⊃ shape are provided with opened ends of the respective notches 26 opposed to each other, and the heat shrinkable film 21 and a mount 22 are bonded to each other in a portion between the opposed ends of the notches 26 and ends on both sides in the notches 26. The strip-shaped holding member body 30 is formed in the shape of an inverted truncated conical cylinder with the heat shrinkable film 21 in the laminated body 20 positioned on the inner side. In this state, both ends of the holding member body 30 are bonded to each other with adhesives 31 provided therein.

If the cup 10 is contained in the holding member body 30 thus formed in the shape of an inverted truncated conical cylinder, and hot drink is supplied to the cup 10 in this state, the heat shrinkable film 21 positioned on the inner side shrinks by heat from the cup 10 in each of the laminated bodies 20 provided for the holding member body 30, and the mount 22 is raised from the heat shrinkable film 21 due to the difference in shrinkage between the heat shrinkable film 21 and the mount 22. If a person has the raised portion of the mount 22 in his or her hand, the hand does not get hot, thereby to make it possible to safely hold the cup 10.

A portion other than the laminated bodies 20 each provided with the notches 26 in a ⊃ shape in the above described holding member body 30 may be so constructed that the heat shrinkable film 21 is bonded to the whole of the mount 22, or may be constituted by only the mount 22 having a low heat shrinkage percentage.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A heat insulating container comprising:

a container body; and a laminated body in which base materials which differ in heat shrinkage percentages are laminated, said base materials in the laminated body being bonded to each other by bonded portions spaced apart from each other, the base material having a high heat shrinkage percentage in the laminated body being mounted with it directed toward an outer surface of the container body.

2. The heat insulating container according to claim 1, wherein the container body is composed of a material having a small wall thickness, and is formed in such a shape as to shrink toward the bottom.

3. The heat insulating container according to claim 1, wherein the container body is composed of paper.

4. The heat insulating container according to claim 1, wherein a portion between the bonded portions bonding the base materials to each other in the laminated body is in an unbonded state.

5. The heat insulating container according to claim 1, wherein the base material having a low heat shrinkage percentage in the laminated body is composed of a material having a low coefficient of thermal conductivity.

6. The heat insulating container according to claim 1, wherein the base material having a low heat shrinkage percentage in the laminated body is subjected to processing for bending.

7. The heat insulating container according to claim 1, wherein the base materials in the laminated body are bonded to each other by a plurality of strip-shaped bonded portions.

8. The heat insulating container according to claim 1, wherein a body portion in the container body is formed in a cylindrical shape, the base material having a high heat shrinkage percentage in the laminated body which is mounted on an outer peripheral surface of the body portion shrinking in the circumferential direction of the body portion.

9. A container holding member, wherein a laminated body in which base materials which differ in heat shrinkage percentages are laminated after being bonded to each other by bonded portions spaced apart from each other is provided in a holding member body in a shape corresponding to the shape of a container, the base material having a high heat shrinkage percentage in the laminated body being positioned on the inner side with it opposed to the container.

* * * * *

UNITED STATES PATENT AND TRADEMARK OFFICE

CERTIFICATE OF CORRECTION

PATENT NO. : 5,469,983
DATED : November 28, 1995
INVENTOR(S) : Masaya YAWATA

It is certified that error appears in the above-indentified patent and that said Letters Patent is hereby corrected as shown below:

On the cover page, Item [73], "Sado Yawata" should be –Sadao Yawata–.

Signed and Sealed this

Eighteenth Day of March, 1997

*Attest:*

*Attesting Officer*

Bruce Lehman

BRUCE LEHMAN

*Commissioner of Patents and Trademarks*